United States Patent [19]

Kain

[11] 4,121,737

[45] Oct. 24, 1978

[54] APPARATUS FOR PRESSURE DISPENSING OF FLUIDS

[75] Inventor: Calvin L. Kain, Bartlesville, Okla.

[73] Assignee: Kain's Research and Development Co., Inc., Gretna, La.

[21] Appl. No.: 634,500

[22] Filed: Nov. 24, 1975

[51] Int. Cl.[2] ..... B65D 35/28

[52] U.S. Cl. ..... 222/95; 222/212

[58] Field of Search ..... 222/94, 105, 107, 212, 222/215, 386.5, 95

[56] References Cited

U.S. PATENT DOCUMENTS

| | | | |
|---|---|---|---|
| 3,608,781 | 9/1971 | Flynn | 222/94 |
| 3,876,115 | 4/1975 | Venus et al. | 222/212 X |
| 3,961,725 | 6/1976 | Clark | 222/212 X |

*Primary Examiner*—Robert B. Reeves
*Assistant Examiner*—John P. Shannon
*Attorney, Agent, or Firm*—Vinson & Elkins

[57] ABSTRACT

An apparatus for pressure dispensing of fluid products is provided having an elastomeric pressure unit disposed in surrounding relationship to a flexible, fluid-tight liner. The liner has its open end sealably engaged with a valve support, having a dispensing valve therein. The inherent contracting force which returns an expanded elastomeric pressure unit to its normal unexpanded position, provides the dispensing pressure for the product contained within the flexible liner, while the liner prevents contact between the product and the elastomeric material of the pressure unit. This abstract is not to be construed in any way to define or limit the invention set forth below.

3 Claims, 6 Drawing Figures

APPARATUS FOR PRESSURE DISPENSING OF FLUIDS

BACKGROUND OF THE INVENTION

This invention relates to pressurized fluid product dispensing apparatus. More particularly, it relates to apparatus for pressure dispensing of fluid products, including very fine powders, without the use of pressurizing gases or propellant gases, in which the dispensing pressure is supplied by the inherent contracting force of an expanded elastomeric pressure unit.

Pressurized product dispensing containers have become exceedingly popular in recent years. Since its inception, the popularity of this mode of packaging has consistently increased, resulting in the present day availability of numerous products in pressure dispersed or aerosol form. There are, however, certain difficulties with existing pressure dispensing systems. The propellant gas in aerosol dispensers is relatively expensive, and often must be used in equal proportion to the product to be dispensed. Additionally an air space of 20–30% of the volume of the container must be provided for gas expansion under varying thermal conditions as a safety feature. This requires the use of a relatively large container for carrying a small amount of product, resulting in extra expense for container materials and pressurizing gas, and in inefficient space utilization.

In addition, effective gas propellants are sometimes not compatible with certain products, especially foods. Further, aerosol containers are somewhat hazardous since they can explode when subjected to heat or puncture.

More recently, there have been indications that the fluoro-carbon propellant gases which are used in the majority of aerosol containers are incompatible with the upper atmosphere's ozone layer which provides essential protection for the earth from excessive ultraviolet radiation. As a result, environmental groups have called for government legislation banning the use of fluorocarbon propellant gases and have urged the public to refrain from buying aerosol products utilizing such gases. Substitute aerosol propellant gases are not readily available since the extremely low chemical activity of fluoro-carbon gases makes them uniquely compatible with many aerosol products. Therefore, if many aerosol products are to continue to be available, it appears that some gasless dispensing system must be substituted for the present pressurized aerosol systems. Alternative dispensing systems such as finger or trigger type fluid pumps have proved too expensive and unreliable.

It has been suggested in the prior art to use bladders, or pressure units, of elastic material positioned interiorly of containers as a means of dispensing fluid products. In my co-pending application, Ser. No. 378,886, is shown such a fluid dispensing system including a pressure unit of elastomeric material, having an upper tubular portion with its annular surface bonded to a valve support and including means carried by the pressure unit for stiffening the tubular portion of the elastomeric material adjacent to the bonded area, which provides a unique and efficacious gasless product dispensing system.

While apparatus such as shown in my co-pending application provides an entirely satisfactory gasless pressure dispensing system for a wide range of fluid products, there are certain products which are chemically incompatible with the elastomeric material of the pressure unit, or which might tend to pick up an undesirable odor or flavor from the pressure unit's elastomeric material. For certain applications, it is therefore preferable to provide in connection with such a dispensing system, means for separating the product from the elastomeric material of the pressure unit.

It is accordingly, the primary object of the present invention to provide a gasless pressurized product dispensing apparatus in which the dispensing pressure is supplied by the inherent contracting force of an expanded elastomeric pressure unit, which apparatus includes means for containing the product to be dispensed so that said product is protected from contact with the elastomeric material of the pressure unit.

Another object is to provide such an apparatus which is relatively simple and inexpensive to manufacture.

Another object is to provide such an apparatus having a flexible bag which also functions as a liner surrounded by an elastomeric pressure unit, with the bag or liner formed of any suitable material compatible with the product to be dispensed and containing the fluid or other product to be dispensed and serving to separate the fluid from the elastomeric material of the pressure unit.

A particular object is to provide a flexible bag which is of such size that when it is filled with product and the elastomeric pressure unit is expanded, said bag engages the inner wall of the unit to form a liner supported by the pressure unit; said liner functioning to prevent contact of the product with the elastomeric material of the pressure unit.

A further object is to provide such an apparatus which is readily applicable to conventional dispensing valves and containers for pressure dispensed products and which will dispense almost all of the product since most lines materials will fill the core of the pressure unit when it returns to its original relaxed position.

These and other objects and advantages of the apparatus of the present invention will be apparent from the drawings, specification and claims. In the accompanying drawings, in which like numerals indicate like parts:

DETAILED DESCRIPTION

Figure 1:
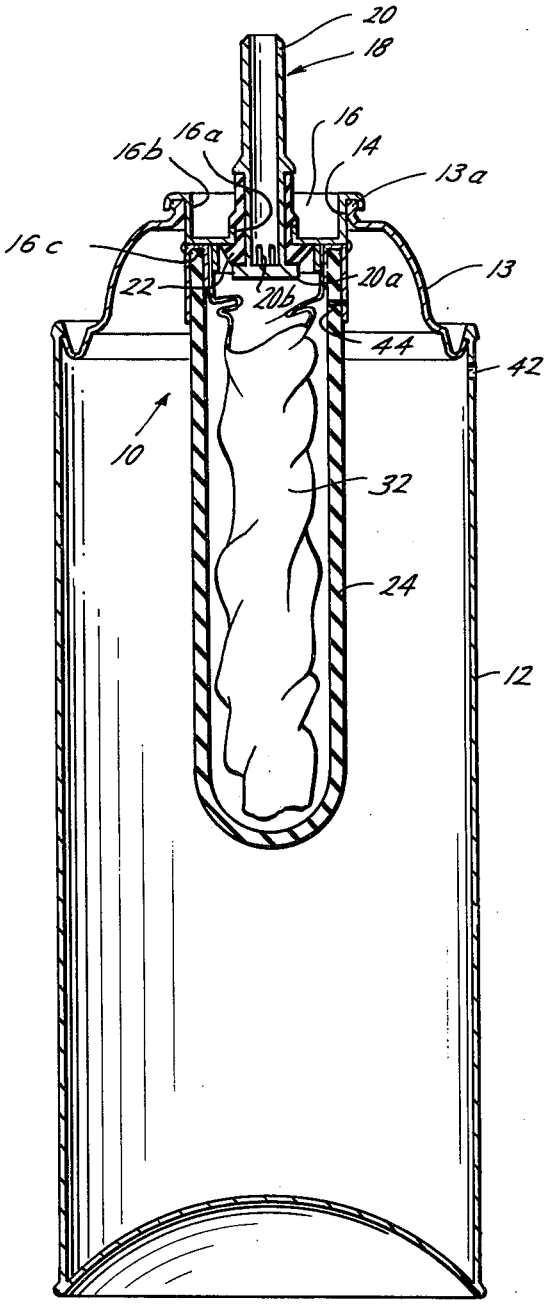
FIG. 1 is a vertical cross-sectional view of the fluid dispensing apparatus of the present invention, housed within a conventional container for aerosol products, with the pressure unit and the bag or liner in their fully collapsed positions ready to be filled with fluid product.

Referring now to the drawings and first to FIG. 1, the apparatus for pressure dispensing of fluids is generally indicated by the numeral 10. In its preferred form, the apparatus is preferably housed within an upright vessel or container 12, which may be formed of metal, cardboard or the like. As illustrated in FIG. 1, the container 12 is a conventional metal can, such as are presently used for aerosol products. As explained more fully hereinafter, the housing is not essential for the functioning of the fluid dispensing apparatus of the invention and it may, if desired, be eliminated. However, a housing or container is useful for confining the pressure unit of the apparatus and makes a uniform package which is more easily labelled, shipped, displayed and used.

The vessel 12 is depicted as being cylindrical in shape, with closed top and bottom, but may be of substantially any shape. An end plate 13 is secured to the upper end of the vessel 12 and has a centrally disposed opening 14 therein, and mounted within the opening 14 is a valve support 16. The valve support 16 has an axial opening 16*a*, which receives a valve generally indicated by the numeral 18. The specific valve structure 18 does not form a part of the present invention, as any desirable valve structure may be utilized. Numerous valve devices are presently on the market and in use at this time.

In the arrangement of FIG. 1, by way of example only, the valve 18 includes a rigid tubular member 20, of material such as plastic, having a horizontal portion 20*a* of enlarged diameter, at the lower end thereof. Openings 20*b* are provided in the tubular portion adjacent the enlarged diameter portion 20*a*. The tubular portion 20 of the valve is received within a resilient retainer 22. Normally, the enlarged diameter portion 20*a* seals against the lower end of the resilient retainer 22 to close the vessel, so that liquids or gases retained interiorally cannot escape. When the tubular element 20 is displaced sideways by finger pressure, the element 20 is tilted in the resilient member 22, exposing one or more of the openings 20*b* and thereby allowing fluid to escape. When the sideways pressure on the tubular element 20 is relieved, it returns to its original axial or upright position and the openings 20*b* are closed. This is one type of valve which will function in connection with the present invention.

The valve support 16 includes a cylindrical wall 16*b* which extends downwardly within the vessel 12 terminating in a lower horizontal surface 16*c*. The valve support described is typical of those in present commercial use, and, while the structures may vary from one manufacturer to another, the valve supports in most common usage have the portions described.

The device described to this point is not unlike those in present use today, wherein the propellant used to cause the contents thereof to be discharged is a compressed gas. In such prior art containers, the interior of the vessel 12 is filled with the material to be discharged and when the valve 20 is opened the propellant gas forces the liquid therein to pass outwardly. Such containers may include a downwardly extending tube (not shown) so that the liquid in the bottom of the container is first discharged.

The apparatus of the present invention, however, requires no propellant gas and instead utilizes a flexible fluid-tight element for containing the product to be dispensed, and an expandable and contractable elastomeric pressure unit disposed in surrounding relationship to at least a portion of the element to provide the dispensing pressure. The element which contains the product is referred to herein as a "bag" or "liner" and these terms are used interchangeably to mean the same thing.

Figure 3:
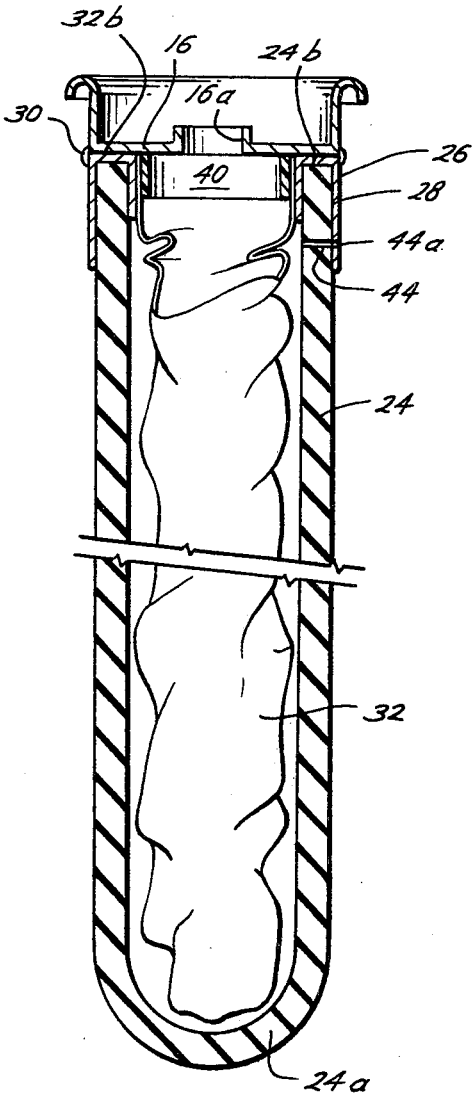
FIG. 3 is an enlarged detail view in vertical cross-section of the valve support, elastomeric pressure unit and bag or liner of FIG. 1, but with the valve omitted for clarity.
Figure 4:
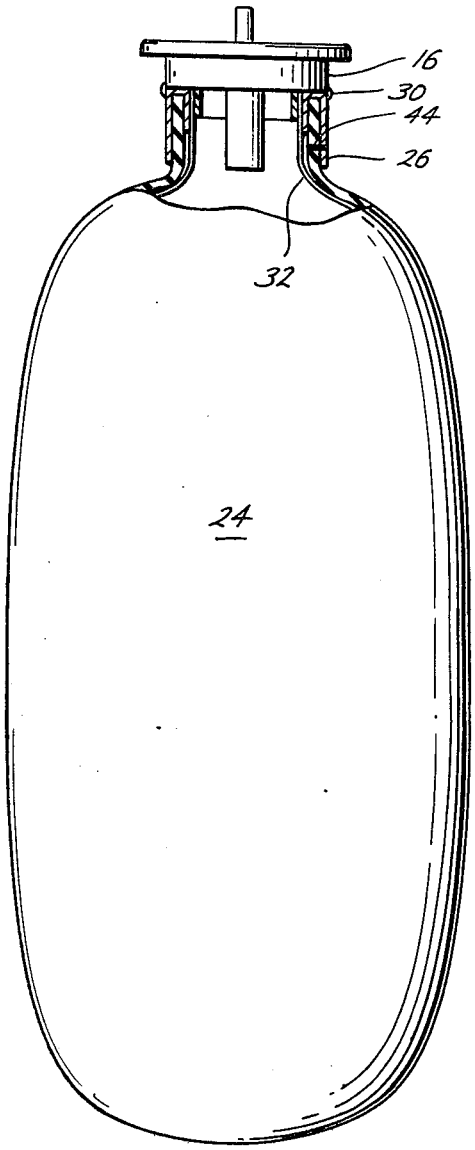
FIG. 4 is a view in vertical cross-section of the apparatus of FIG. 3 in its expanded or filled condition and not confined within a housing or container.

As shown in somewhat greater detail in FIG. 3, there is provided a relatively thick wall pressure unit 24 of suitable elastomeric material such as natural rubber pharmaceutical rubber or other compounds known to those skilled in the art. The pressure unit 24 is preferably of an elongated, generally cylindrical configuration with its lower end 24*a* rounded and closed and its upper end open and terminating in an upper annular surface 24*b*. A crown 26 of any suitable, relatively rigid material, such as stamped metal is disposed in surrounding relationship to the upper portion of the pressure unit; as shown the crown is of inverted U-shape and engages the upper annular surface 24*b* and a portion of the upper inside and outside circumference. As illustrated, the pressure unit 24 is bonded to the crown 26 by means of a suitable bonding material 28 applied between the adjacent surfaces of the pressure unit and the crown. The crown 26 is in turn fastened to the valve support 16 by any suitable means, such as an annular bead of solder 30. If the tolerances are very close between the outside diameter of the crown and the inside diameter of the container opening, then solder head 30 may be machined down after application or an alternate soldering method used.

Disposed interiorally of the pressure unit 24 is the flexible fluid-tight bag or liner 32 which is relatively thin-walled relative to the wall thickness of the pressure unit. Although the bag or liner is of flexible material, it preferably has only a limited elasticity. The material from which the liner 32 is formed is selected so as to be compatible with the product to be dispensed. Any of the various plastics, such as polyethylene and Seranax (Dow Chemical Company) may be utilized, as well as natural and synthetic rubbers, thermoplastic, elastomeric and other materials known to those skilled in the art. The liner may be of a simple material or from limited combinations of films. For example, a thin sheet of aluminum between two sheets of polyethylene may be desirable in some cases. The only requirements for the material selected are that it be flexible, impermeable to the fluid to be dispensed and compatible with the fluid to be dispensed. Generally the material from which the liner is formed will be different from the material of the pressure unit, since the principal purpose of the liner is to prevent contact between the product to be dispensed and the material of the pressure unit.

It has been found that the materials which are compatible with the widest range of desired products and which are at the same time sufficiently inexpensive to be commercially attractive, are the plastics, such as polyethylene, either high or low density. Such plastics are relatively fluid impermeable, chemically inert and do not result in any undesirable taste or smell contamination of the dispensed products and are non-toxic. However, plastic films are not sufficiently stretchable or elastic or stretchable to expand to the degree required of the pressure unit 24. Therefore, in the preferred embodiment, the bag or liner is preformed of a size and configuration approximately equal to, or slightly larger than, that which it will assume when the apparatus is filled with product and the pressure unit is expanded. Thus, when the pressure unit is expanded the bag forms a "liner on the inner surface of said unit". Where the selected liner material is of relatively low stretchability, it is desirable to pre-form the liner with a slightly larger capacity than that intended for the fully-expanded pressure unit to allow a safety margin in the event that the unit is slightly overfilled.

Figure 5:
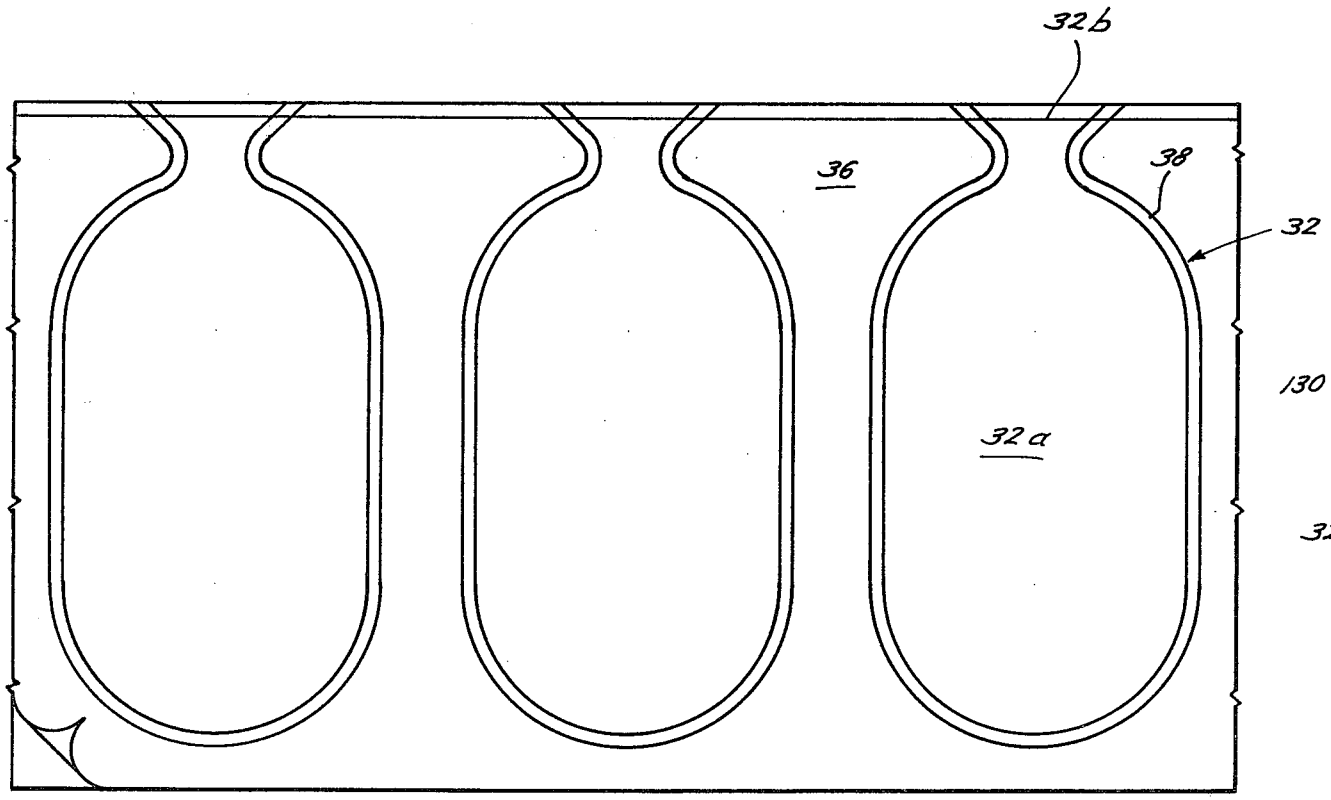
FIG. 5 is an illustration of a plurality of bags or liners for use in the apparatus of the present invention, showing how the same may be manufactured from conventional plastic film sheet material.

The pre-formed liner is first folded or otherwise collapsed to a size which permits its insertion into the open end of the pressure unit in a collapsed, overlapping confirguration as illustrated in FIG. 3. As will be explained, the liner will unfold to its desired size as the apparatus is filled with product under pressure. FIG. 5 illustrates the manner in which a plurality of bags or liners can be formed from a double sheet of plastic material 36. The double sheet is suitably bonded or bar-heat sealed or electronically sealed along an outline 38 to provide the liners 32 of desired configuration including an enlarged body portion 32*a*, and a neck portion 32*b*. The individual liners may then be separated from the roll or sheet of liners and inserted into the pressure units 24 in a collapsed or folded configuration. As illustrated, the two sheets forming the liners should have their upper edges slightly offset to facilitate opening of the finished liners.

The liners are preferably held in place within the pressure units, and placed in sealing engagement with the valve support 16, by disposing the uppermost edge of the liner neck portion 32*b* slightly above the level of the pressure unit retainer 26, and inserting a cylindrical ferrule or retaining ring 40 within the bore of said neck portion. The retaining ring 40 is of a size to frictionally engage the neck portion of the liner between the outer circumference of the retaining ring 40 and the inside of the pressure unit crown 26. The retaining ring 40 may be formed of any suitable material such as metal or plastic. As is apparent, the operation of placing the liner 32 within the pressure unit 24 and binding the liner in place with the retaining ring 40 should be performed prior to soldering the pressure unit crown 26 to the valve support 16.

With this construction, the interior of the liner 32 is placed in sealing engagement with the valve support 16 and in communication with the lower opening to the valve 18, so that fluid product contained within the liner may be dispensed through the valve by means of the return pressure generated by the inherent contracting force of the expanded elastomeric pressure unit 24. Obviously, the product contained within the liner is protected from deleterious contact with the elastomeric material of the pressure unit.

Figure 2:
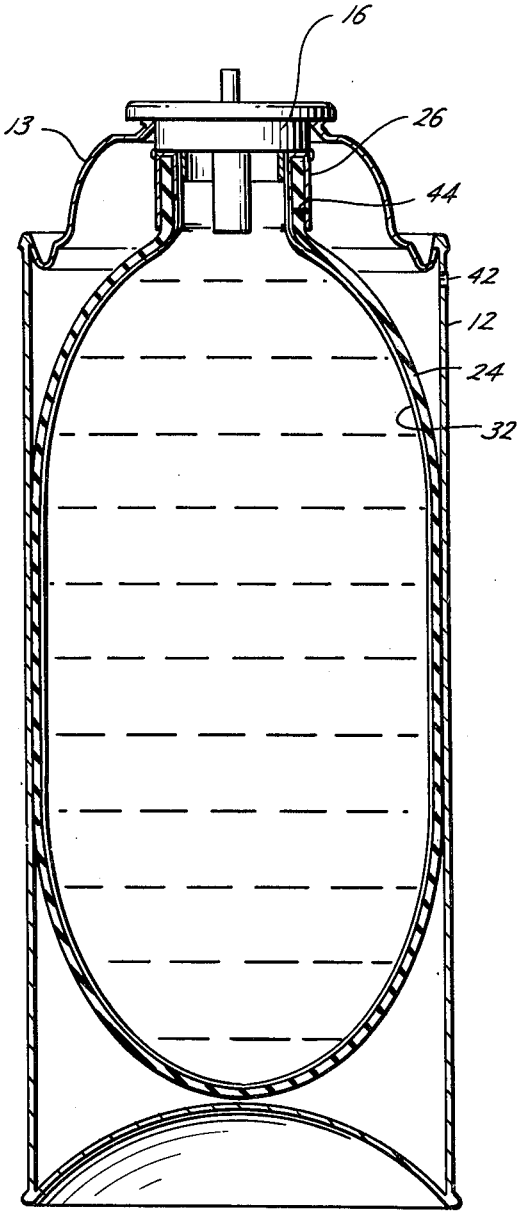
FIG. 2 is a view similar to FIG. 1, showing the bag or liner and pressure unit in their fully expanded, filled, condition and also illustrating an alternate type of valve structure.

In the preferred embodiment, as illustrated in FIGS. 1 through 3, the fluid dispensing apparatus comprising the valve support, valve, elastomeric pressure unit and flexible product liner is assembled prior to placing any product therein and is preferably placed within an outer housing, such as the vessel 12. The valve support 16 is secured to the top end plate 13 of the vessel 12 in any suitable manner, such as crimping the upper end portion of the valve support cylindrical wall 16*b* over a preformed annular flange member 13*a*, which is provided around the opening 14 at the top of end plate 13. Filling the dispensing apparatus with the desired fluid products may then be accomplished by filling either through the valve member 18 thereof, or through the opening in the valve support 16 into which the valve is then sealably inserted after filling is complete.

As the unit is filled with product under sufficient pressure, the elastomeric pressure unit 24 will stretch and expand and the flexible liner 32 will fill with product until these elements reach their final configuration. As illustrated in FIG. 2, if the pressure dispensing apparatus is housed within a container or vessel, the pressure unit will assume as its maximum expansion, an elongated cylindrical configuration, rounded at the bottom, within the maximum length and diameter dimensions permitted by the container. Generally, the pressure unit will not engage the inside walls of the container, so that no pressure is exerted on the container, permitting the use of various low pressure container materials such as plastic or cardboard. The liner will assume the same size as the pressure unit and will engage the inner wall thereof. Thus, the liner is supported by the pressure unit and may be of lighter weight and strength without danger of being ruptured by the pressure. Because the liner 32 need not carry any pressure, it may be formed from extremely thin material, such as, for example, 1 to 3 mil thick polyethylene film or other suitable films.

As a safety feature, it may be desirable to provide one or more small openings in the pressure unit 24, such as indicated at 44, through which product which may be leaking from a torn or punctured liner could escape. As the product escaped, the pressure unit would collapse, providing a safeguard against use of a product contaminated due to liner failure. The small opening 44 is preferably provided near the top of the pressure unit, within the portion bonded to the crown 26. A corresponding opening 44*a* is provided in the crown 26. The bonded portion of the pressure unit undergoes little, if any, expansion during filling of the pressure unit. An opening in any other part of the pressure unit would enlarge substantially during filling of the unit. If opening 44 is used, care must be taken that the liner is sufficiently strong not to rupture through the opening 44.

For purposes of allowing air confined within the vessel, prior to filling, to escape as the pressure unit expands, it may be desirable to provide a small vent, such as vent 42 in the top of vessel wall.

Figure 6:
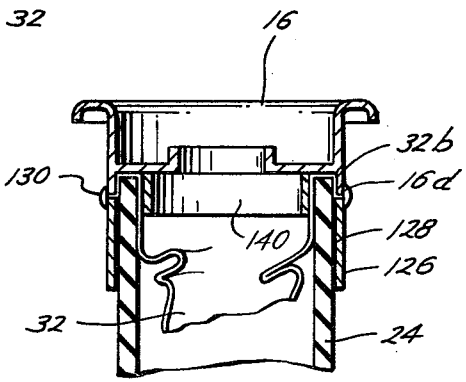
FIG. 6 is an enlarged detail view in vertical cross-section illustrating an alternate manner of attachment of the bag or liner.

Referring next to FIG. 6, there is illustrated an alternate form of the apparatus, wherein the valve support 16 has a downwardly projecting lip 16*d*. The upper tubular portion of the pressure unit 24 has a portion of its outer diameter bonded to an annular crown ring 126 and extends upwardly above the crown ring 126 to engage the lower surface of the valve support 16. The upper portion or neck 32*b* of the bag or liner 32 is then disposed in overlapping relationship between the upper annular surface of the pressure unit portion 24*b* and the lower surface of the valve support 16, so as to be sealably engaged with the valve support 16 by compression of the upper portion of the pressure unit when the retaining ring 126 is connected to the valve support 16 by solder or resistance welding at 130. Depending upon the strength and stretchability of the liner material, a retaining ring 140 may be used to support the liner within the pressure unit.

As described, in the preferred embodiment, the bag or liner 32 is formed of flexible, but relatively non-elastic material, of limited stretchability, since such materials have been found to have the widest range of compatibility with desired products. However, it may be that in certain instances, highly stretchable, or even fully elastic materials, such as natural latex, may be suitable for the liner, in which event, the liner may be formed either by spraying or molding it to the inside surface of the pressure unit 24, or by providing a separate liner of lesser outside diameter than the inside diameter of the pressure unit 24, which may be more easily disposed within the pressure unit 24 and which will stretch as it fills with product to assume the same final configuration as the pressure unit.

The above and foregoing disclosure and description of the invention is illustrious of an explanatory thereof, and various changes in the size, shape, materials and details of construction may be made within the scope of the appended claims without departing from the spirit of the invention.

What is claimed is:

1. An apparatus for pressure dispensing fluid products comprising:

a valve support;

normally closed valve means carried by said valve support for providing a fluid passageway therethrough;

a flexible liner sealably engaged with said valve support for containing the fluid product to be dispensed;

an expandable and contractible pressure unit of elastomeric material disposed in surrounding relationship to at least a portion of said liner;

a rigid crown surrounding the upper inside and outside circumference of said elastomeric pressure unit and attached to said pressure unit;

means for attaching said crown to said valve support to thereby sealably engage said elastomeric pressure unit with said valve support;

said liner including an upper neck portion disposed within said crown;

a retaining ring disposed within the neck of said liner to frictionally confine the neck of said liner between said retaining ring and said crown to thereby sealably engage said liner with said valve support;

said liner being relatively thin-walled as compared to said pressure unit and being of a material compatible with the fluid product to be dispensed, whereby, fluid product contained within said liner when said pressure unit is in an expanded position is subjected to the inherent contracting force of the elastomeric material of said pressure unit and may be selectively expelled through said valve means by such force.

2. An apparatus for pressure dispensing fluid products comprising:

a valve support;

normally closed valve means carried by said valve support for providing a fluid passageway therethrough;

a flexible liner sealably engaged with said valve support for containing the fluid product to be dispensed; and, an expandable and contractible pressure unit of elastomeric material disposed in surrounding relationship to at least a portion of said liner, a rigid ring attached to the upper outside circumference of said elastomeric pressure unit;

means for attaching said ring to said valve support;

said elastomeric pressure unit extending above the top of said ring; and said liner including a neck portion extending over the upper surface of said elastomeric pressure unit, whereby when said ring is attached to said valve support, said liner neck is compressed between the underside of said valve support and the upper surface of said elastomeric pressure unit, to thereby sealably engage said liner with said valve support means, said liner being relatively thin-walled as compared to said pressure unit and being of a material compatible with the fluid product to be dispensed, whereby, fluid product contained within said liner when said pressure unit is in an expanded position is subjected to the inherent contracting force of the elastomeric material of said pressure unit and may be selectively expelled through said valve means by such force.

3. The apparatus according to claim 2 comprising additionally:

a retaining ring disposed within the neck of said liner for frictionally confining the neck of said liner between said retaining ring and the upper inside surface of said pressure unit.

* * * * *